US005125802A

United States Patent [19]

Nakamura et al.

[11] Patent Number: 5,125,802

[45] Date of Patent: Jun. 30, 1992

[54] INJECTION TIMING CONTROL APPARATUS FOR DISTRIBUTOR TYPE FUEL INJECTION PUMPS

[75] Inventors: Hisashi Nakamura; Satoru Ito, both of Higashi-Matsuyama, Japan

[73] Assignee: Zexel Corporation, Japan

[21] Appl. No.: 615,347

[22] Filed: Nov. 19, 1990

[30] Foreign Application Priority Data

Dec. 19, 1989 [JP] Japan ..... 1-327154

[51] Int. Cl.[5] ..... F02M 59/20

[52] U.S. Cl. ..... 417/221; 123/501; 123/502

[58] Field of Search ..... 417/221; 123/500, 501, 123/502, 179 L

[56] References Cited

U.S. PATENT DOCUMENTS

| | | | |
|---|---|---|---|
| 3,051,154 | 8/1962 | Kemp | 123/502 |
| 3,552,366 | 1/1971 | Kemp | 123/502 |
| 4,224,916 | 9/1980 | Davis | 123/502 |
| 4,262,645 | 4/1981 | Kobayashi | 123/501 |
| 4,329,961 | 5/1982 | Johnston | 123/502 |
| 4,355,621 | 10/1982 | Yasumara | 123/501 |
| 4,408,591 | 10/1983 | Nakamura | 123/502 |
| 4,476,837 | 10/1984 | Salzgeber | 123/501 |
| 4,526,154 | 7/1985 | DiDomenico | 123/502 |
| 4,610,234 | 9/1986 | Sakuranaka | 123/179 L |
| 4,778,358 | 10/1988 | Pape | 417/500 |

*Primary Examiner*—Richard A. Bertsch
*Assistant Examiner*—Peter Korytnyk
*Attorney, Agent, or Firm*—Ostrolenk, Faber, Gerb & Soffen

[57] ABSTRACT

A fuel injection timing control apparatus for a distributor type fuel injection pump which enables the advantages of a servo valve arrangement provided in a timing piston to be utilized with the servo valve being disposed on the timing piston high-pressure chamber side. The fuel injection apparatus can be applied to engines with parts on the timer low-pressure chamber side without this causing interference, because the servo valve and any control mechanism are provided on the high-pressure chamber side.

28 Claims, 8 Drawing Sheets

INJECTION TIMING CONTROL APPARATUS FOR DISTRIBUTOR TYPE FUEL INJECTION PUMPS

BACKGROUND OF THE INVENTION

1. Field of the Invention

The present invention relates to an injection timing control apparatus for distributor type fuel injection pumps, particularly to an injection timing control apparatus for distributor type fuel injection pump which uses a servo valve.

2. Description of the Prior Art

With conventional fuel injection pumps, an increase in engine speed has to be matched by an advance in the fuel injection timing to ensure that the fuel is injected with the optimum timing. For this, the fuel injection pump is equipped with a fuel injection timing control device (timer).

Usually, a pressure control valve is used to produce a rise in the pressure in the pump chamber corresponding to the increase in the engine speed, and the injection timing is controlled by controlling the timer, using this pump chamber pressure as the pressure source.

There are timers which are provided with servo valve arrangements. In the injection timing adjustment apparatus for a distributor type fuel injection pump according to Japanese Patent Laid-open Application 58-32928/1983, for example, to prevent the torque reaction from the plunger cam disk setting up vibration in the roller, a servo valve is used to temporarily break the connection between the pump chamber and the timer high-pressure chamber, creating a hydraulic lock.

A conventional injection timing adjustment apparatus for a distributor type fuel injection pump will now be briefly described, with reference to FIG. 7. FIG. 7 is a longitudinal cross-sectional view of a conventional injection timing adjustment apparatus 1 for a distributor type fuel injection pump. A roller holder 4 is arranged in a pump chamber 3 formed in a pump housing 2. A roller 5 is rotatably held by the roller holder 4, and abuts the cam disk of a plunger (not shown) which is mounted in the pump housing 2. A drive shaft (not shown) drives the plunger in a reciprocating rotational motion to intake and inject the fuel.

A lever 6 is affixed to the roller holder 4. The contact between the roller 5 and the cam disk can be altered by adjusting the angle of the lever 6 to change the range of the operating cam surface and thereby control the fuel injection timing.

The end of the lever 6 contacts a timer piston 8 via a slide roller 7. This timer piston 8 is capable of reciprocating motion in a timer cylinder 9 formed in the pump housing 2. One end of the timer cylinder 9 is sealed shut by a lid member 10 and an O-ring 11, forming a timer high-pressure chamber 12 between the timer piston 8 and the lid member 10. The other end of the timer cylinder 9 is also sealed by a lid member 13 and a O-ring 14, forming a timer low-pressure chamber. The timer low-pressure chamber 15 is connected to a low-pressure section at the intake side of the fuel feed pump (not shown).

A timer piston play damper spring 16 is provided between the lid member 13 and the timer piston 8 which together with a servo valve control spring 19, described below, urges the timer piston 8 towards the timer high-pressure chamber 12.

A guide bushing 17 is affixed in the timer piston 8. The guide bushing 17 contains a servo valve 18 which can be moved to the left and right, with respect to the drawing. A servo valve control spring 19 is provided between the servo valve 18 and the lid member 13.

Formed in the timer piston 8 is a high-pressure hydraulic passage 20 which communicates to the timer high-pressure chamber 12. In the guide bushing 17 are formed an inflow high-pressure aperture 21 that communicates with the pump chamber 3, and a communicating aperture 22 that communicates with the high-pressure hydraulic passage 20. Formed in the servo valve 18 is a low-pressure-side communicating passage 23 which can be connected to the communicating aperture 22 and to the timer low-pressure chamber 15.

In FIG. 7 the injection timing adjustment apparatus 1 for a distributor type fuel injection pump thus configured is shown in the maximum retarded state, in which the rise in pressure in the pump chamber 3 is exerted on the servo valve 18 via the high-pressure aperture 21, moving the servo valve 18 to the right against the force of the servo valve control spring 19 and bringing the high-pressure aperture 21 into communication with the communicating aperture 22. As a result, the high pressure in the pump chamber 3 extends, via the high-pressure hydraulic passage 20, to the timer high-pressure chamber 12, also moving the timer piston 8 to the right. This causes the lever 6 to rotate counterclockwise, which changes the range of contact between the roller 5 and the face of the cam disk, enabling the timing to be advanced. This position is stabilized when the movement of the timer piston 8 to the right breaks the communication between the high-pressure aperture 21 and the communicating aperture 22.

A pressure drop in the pump chamber 3 will cause the servo valve 18 to be moved to the left by the force of the servo valve control spring 19. This brings the communicating aperture 22 into communication with the high-pressure hydraulic passage 20, allowing fluid under high pressure in the timer high-pressure chamber to flow into the timer low-pressure chamber 15. This moves the timer piston 8 to the left and rotates the lever 6 clockwise, retarding the timing. This conventional servo valve timer, that is, the injection timing adjustment apparatus 1 for a distributor type fuel injection pump, features good response compared with a standard timer that does not have a servo valve 18, and other advantage include low hysteresis and the small effect that advancing the timing has on changes in the fuel injection amount. On the other hand, as the servo valve 18 is located on the timer low-pressure chamber 15 side of the lever 6, assuming that the direction of rotation of the engine, i.e. of the cam disk and the plunger is the same, a servo valve 18 cannot be provided in cases where the engine is located on the timer low-pressure chamber 15 side as the engine cylinder block would be in the way. Thus, the servo valve arrangement is only applicable to a limited number of engine types.

This problem is not limited to the above-described injection timing control apparatus 1 in which the servo valve 18 is driven by the hydraulic pressure in the pump chamber 3, but also arises in the case of other injection timing control apparatus that use solenoids and the like. This is explained in the following, in which parts which are the same as those in FIG. 7 have the same reference numerals.

FIG. 8 shows an injection timing adjustment apparatus 30 in which a servo valve 33 is screwed into a rod 32 of an actuator such as linear solenoid 31 and is provided with an actuator play damper spring 34. In addition, a timer piston play damper spring 35 is provided between the timer piston 8 and the linear solenoid 31.

A high-pressure hydraulic passage 36 is formed in the timer piston 8, a high-pressure hydraulic passage 38 in the guide bushing 37 and an annular groove 39 in the servo valve 33. In addition, provided in the servo valve 33 are a center low-pressure hydraulic passage 40 which communicates with the annular groove 39, and a radial low-pressure hydraulic passage 41 which communicates with the center low-pressure hydraulic passage 40.

In this arrangement, when the servo valve 33 is moved to the right by the linear solenoid 31, the pump chamber 3 is brought into communication with the timer high-pressure chamber 12 via the high-pressure hydraulic passage 36, the high-pressure hydraulic passage 38, the annular groove 39, the communicating aperture 22 and the high-pressure hydraulic passage 20, whereby the timer piston 8 is moved to the right by the pump chamber pressure, advancing the timing.

Conversely, when the servo valve 33 is moved to the left by the linear solenoid 31, the timer high-pressure chamber 12 is brought into communication with the timer low-pressure chamber 15 via the high-pressure hydraulic passage 20, the center low-pressure hydraulic passage 40 and the radial low-pressure hydraulic passage 41, moving the timer piston 8 to the left and retarding the timing.

The advantage of this type of injection timing adjustment apparatus 30 include structural simplicity, good precision, and good resistance to interference from the drive reaction (torque reaction). However, as in the case of the injection timing adjustment apparatus 1 described above, the servo valve 33 and the linear solenoid 31 are located on the timer low-pressure chamber 15 side of the lever 6, with the linear solenoid 31 protruding quite considerably, making it impossible to avoid interference with the engine.

SUMMARY OF THE INVENTION

It is an object of the present invention to provide an injection timing control apparatus for a distributor type fuel injection pump which enables the advantages of the servo valve arrangement to be utilized by being provided with the ability to accommodate engines arrangements in which parts of the engine are on the timer low-pressure chamber side.

The above and other objects are attained by the injection timing control apparatus for a distributor type fuel injection pump according to the present invention comprising a timer piston which is associated with the roller holder lever and moves in response to the pressure in the timer high-pressure chamber, and a servo valve slidably provided in the timer piston, wherein the servo valve is arranged on the timer high-pressure chamber side of the roller holder lever.

In the case of an injection timing control apparatus which utilizes the pressure in the pump chamber for the operation and positioning of the servo valve, the apparatus is configured so that even if the servo valve control pressure chamber which routes the pump pressure chamber is arranged on the timer high-pressure chamber side, it does not communicate with the timer high-pressure chamber.

Moreover, in the case of an injection timing adjustment apparatus utilizing a solenoid means or the like, the solenoid means is provided on the timer high-pressure chamber side.

With the injection timing control apparatus for a distributor type fuel injection pump according to the present invention, unlike in the conventional arrangement, the servo valve is not provided on the timer low-pressure chamber side of the lever but on the timer high-pressure chamber side, minimizing external projections or the timer low-pressure chamber side, making this an apparatus that is flexibly adaptable to the positional arrangement of the engine and utilizes the advantages of the servo valve arrangement.

Further features of the invention, its nature and various advantages will be more apparent from the accompanying drawings and following detailed description of the invention.

DETAILED DESCRIPTION OF THE INVENTION

Figure 1:
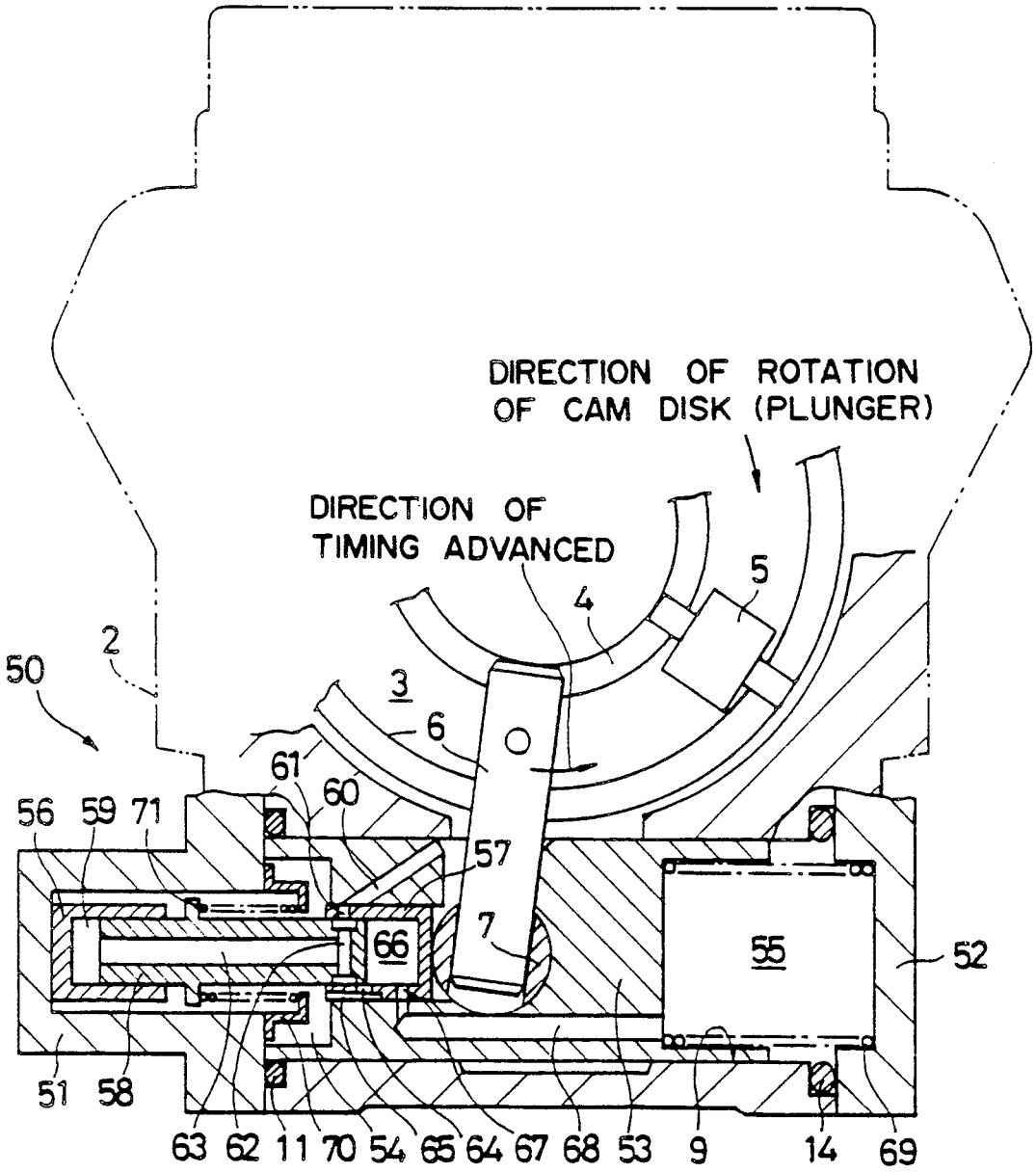
FIG. 1 is a longitudinal cross-section drawing of an injection timing control apparatus for a distributor type fuel injection pump according to a first embodiment of the present invention.
Figure 2:
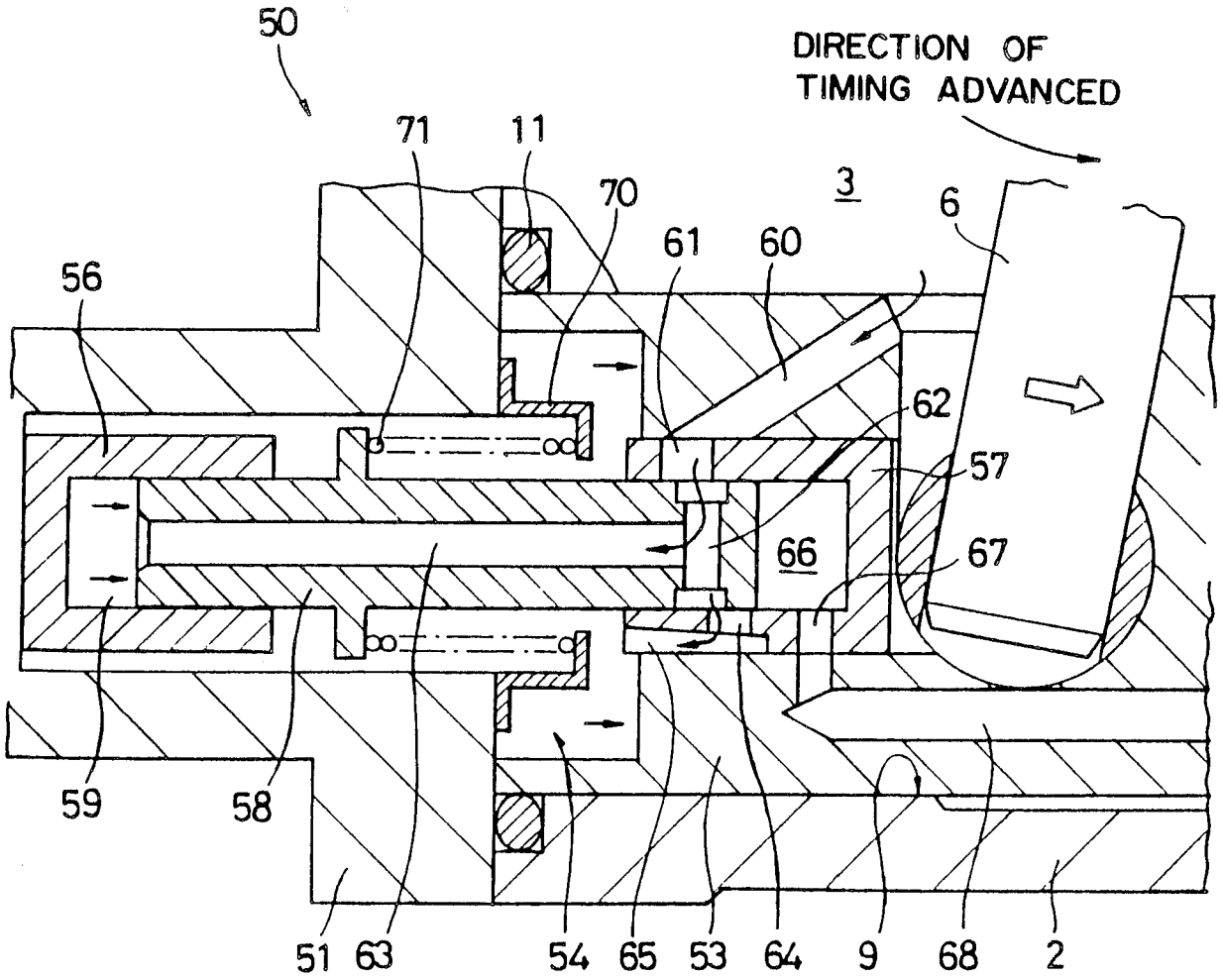
FIG. 2 is a magnified cross-sectional view of the principal parts of the first embodiment when the timing is advanced.
Figure 3:
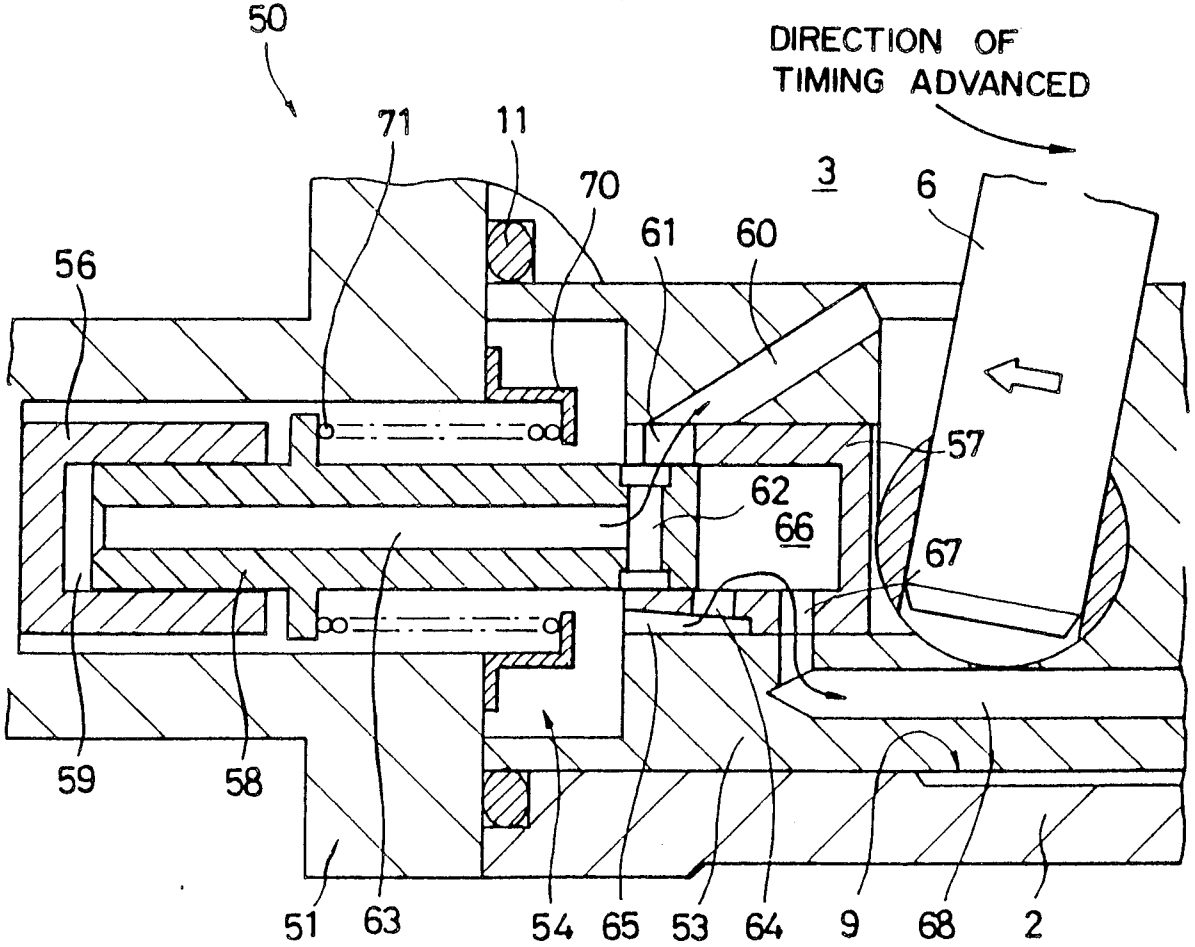
FIG. 3 is a magnified cross-sectional view of the principal parts of the first embodiment when the timing is retarded.

A first embodiment of the present invention will now be described with reference to FIGS. 1 to 3. FIG. 1 is a longitudinal cross-section drawing of an injection timing control apparatus 50 for a distributor type fuel injection pump and FIGS. 2 and 3 are magnified cross-sectional views of the principal parts of the first embodiment, the former when the timing is advanced and the latter when the timing is retarded.

A timer cylinder 9 is formed between lid members 51 and 52. Provided in the timer cylinder 9 is a timer piston 53 which can slide back and forth. The space between the timer piston 53 and the lid member 51 forms a timer high-pressure chamber 54, and the space between the timer piston 53 and the other lid member 52 forms a timer low-pressure chamber 55. A servo valve control pressure chamber body 56 affixed in the timer high-pressure chamber 54 and an opposed guide bushing 57 provided in the timer piston 53 contain a servo valve 58 which can slide back and forth.

Formed between the servo valve 58 and the servo valve control pressure chamber body 56 is a servo valve control pressure chamber 59 into which high-pressure fluid is brought from the pump chamber 3. For this, a high-pressure hydraulic passage 60 is formed in the timer piston 53, an intake port 61 in the guide bushing 57, and a radial communicating passage 62 and a center communicating passage 63 in the servo valve 58, and this center communicating passage 63 communicates with the servo valve control pressure chamber 59.

In addition, the guide bushing 57 has a communicating port 64 and a communicating groove 65 which opens into the timer high-pressure chamber 54. The space between the guide bushing 57 and the servo valve 58 forms a low-pressure-side communicating chamber 66. An intake port 67 formed in the guide bushing 57 and a low-pressure-side passage 68 in the timer piston 53 enables the low-pressure-side communicating chamber 66 to be connected to the timer low-pressure chamber 55.

A timer piston play damper spring 69 is provided between the timer piston 53 and the lid member 52, and a servo valve control spring 71 is provided between the servo valve 58 and a spring seat 70 that is supported by the lid member 51.

In the injection timing control apparatus for a distributor type fuel injection pump 50 thus configured, when there is a rise in the fuel pressure in the pump chamber 3, this fuel pressure is communicated via the high-pressure hydraulic passage 60, the intake port 61, the radial communicating passage 62 and the center communicating passage 63 to the servo valve control pressure chamber 59, thereby to move the servo valve 58 to the right. This brings the pump chamber 3 into communication with the timer high-pressure chamber 54 via the radial communicating passage 62, communicating port 64 and communicating groove 65, and the movement of the timer piston 53 to the right turns the lever 6 counterclockwise, advancing the timing, and stability is reached when the communicating port 64 is closed.

Conversely, as shown in FIG. 3, when there is a drop in the fuel pressure in the pump chamber 3 the servo valve 58 is moved to the left by the force of the servo valve control spring 71 and there is an outflow of fuel from the servo valve control pressure chamber 59. As a result, the timer high-pressure chamber 54 is brought into communication with the timer low-pressure chamber 55 via the communicating groove 65, the communicating port 64, the low-pressure-side communicating chamber 66, the intake port 67 and the low-pressure-side passage 68, and the movement of the timer piston 53 to the left turns the lever 6 clockwise, retarding the timing.

The function of the servo valve 58 can thus be utilized, and the servo valve 58 itself can be positioned on the timer high-pressure chamber 54 side of the lever 6, avoiding interference with the lid member 52 on the timer low-pressure chamber 55 side.

Moreover, there is in fact little need to provide the timer piston play damper spring 69, and even when a spring is used it can be made very short. This means that the lid member 52 on the timer low-pressure chamber 55 side protrudes much less than in a conventional arrangement, so there are no design problems even when parts of the engine are located on the timer low-pressure chamber 55 side. This enables the range of application of the invention to be broadened and the advantages of the servo valve system utilized to good effect, including with respect to exhaust gas emission controls.

Furthermore, compared with conventional servo valve timers there is a large degree of freedom concerning the outer diameter of the servo valve control spring, and this degree of freedom can be increased. It is also possible to develop readily the arrangement into a two-stage spring timer.

Figure 4:
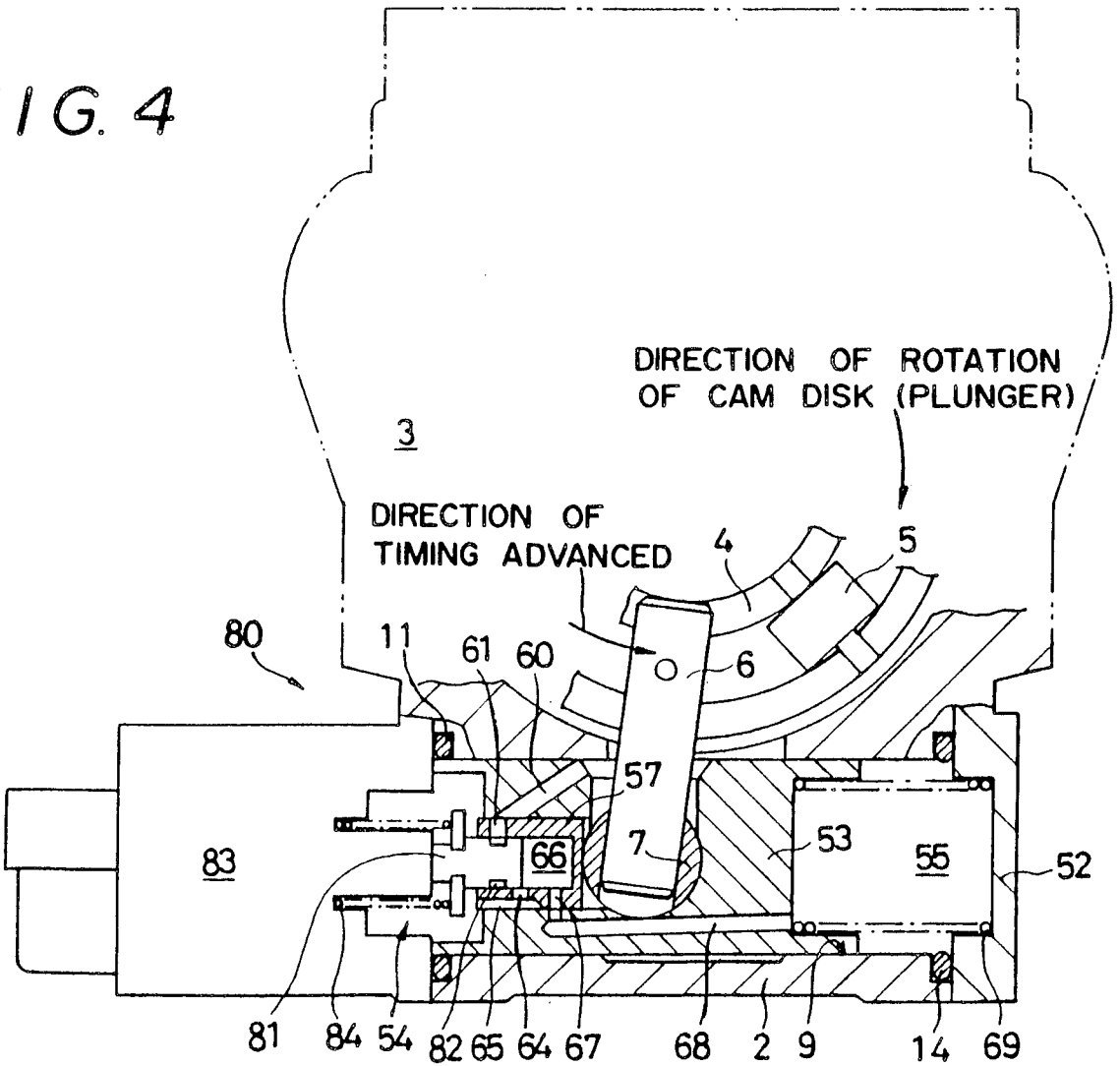
FIG. 4 is a longitudinal cross-section drawing of an injection timing control apparatus for a distributor type fuel injection pump according to a second embodiment of the invention.

A second embodiment of the present invention will now be described with reference to FIGS. 4 to 6. FIG. 4 is a longitudinal cross-section drawing of an injection timing control apparatus 80 for a distributor type fuel injection pump and FIGS. 5 and 6 are magnified cross-sectional views of the principal parts of the second embodiment, the former when the timing is advanced and the latter when the timing is retarded.

In the injection timing control apparatus 80, an annular groove 82 is formed in a servo valve 81. A linear solenoid 83, for example, is used to constitute an actuator which is used to impart reciprocal motion to the servo valve 81.

The provision of the linear solenoid 83 on the timer high-pressure chamber 54 side of the lever 6 and other such structural details are substantially the same as those of the injection timing control apparatus 50, and further explanation thereof is therefore omitted here. Reference numeral 84 denotes a linear solenoid play damper spring.

Figure 5:
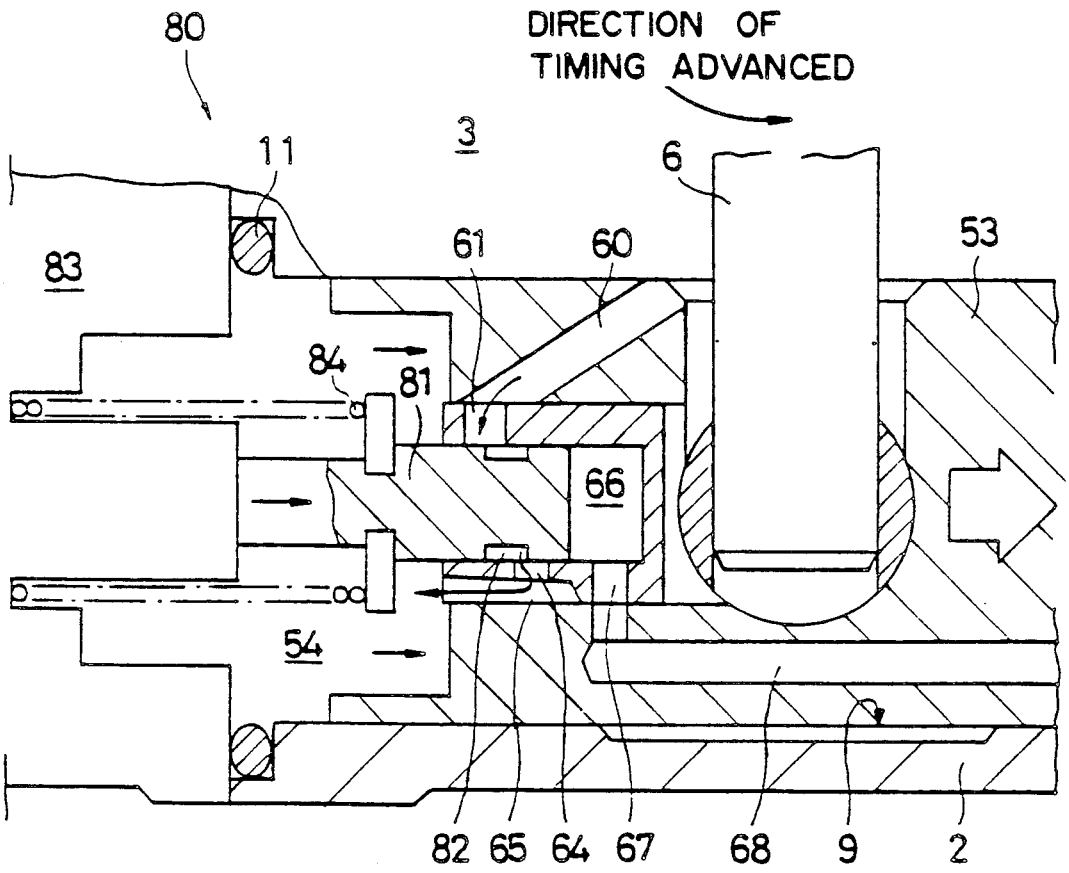
FIG. 5 is a magnified cross-sectional view of the principal parts of the first embodiment when the timing is advanced.
Figure 6:
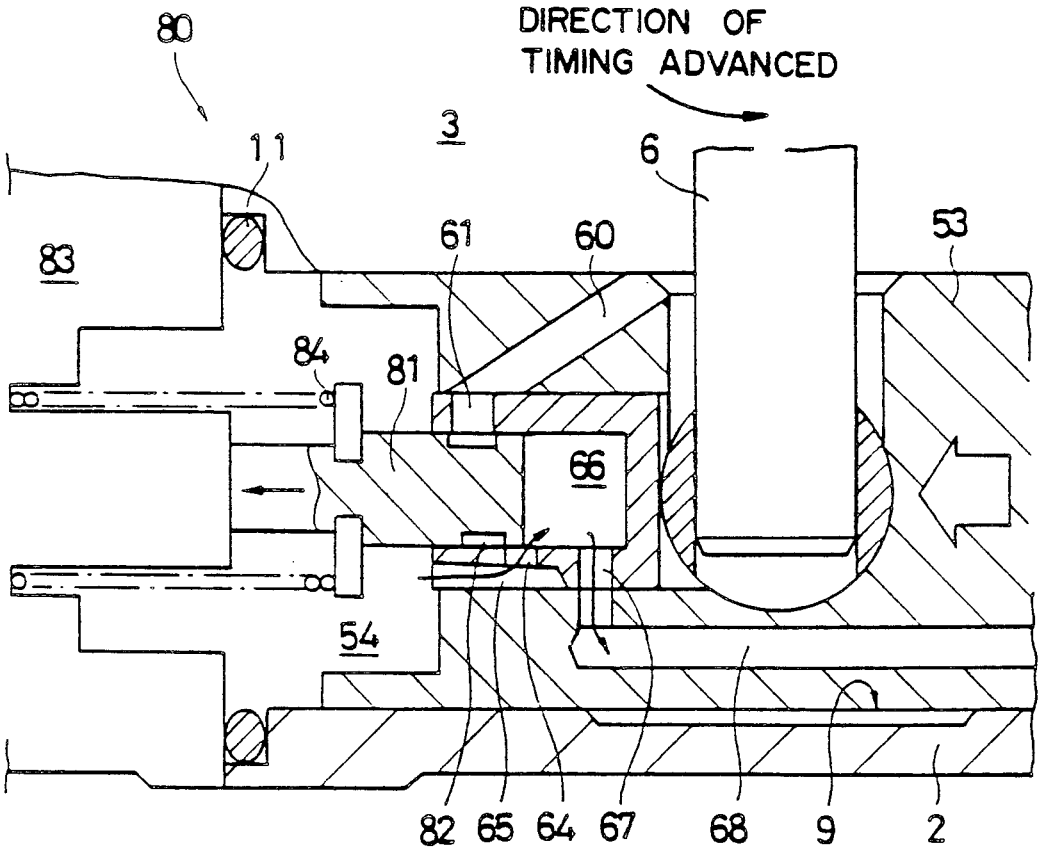
FIG. 6 is a magnified cross-sectional view of the principal parts of the first embodiment when the timing is retarded.
Figure 7:
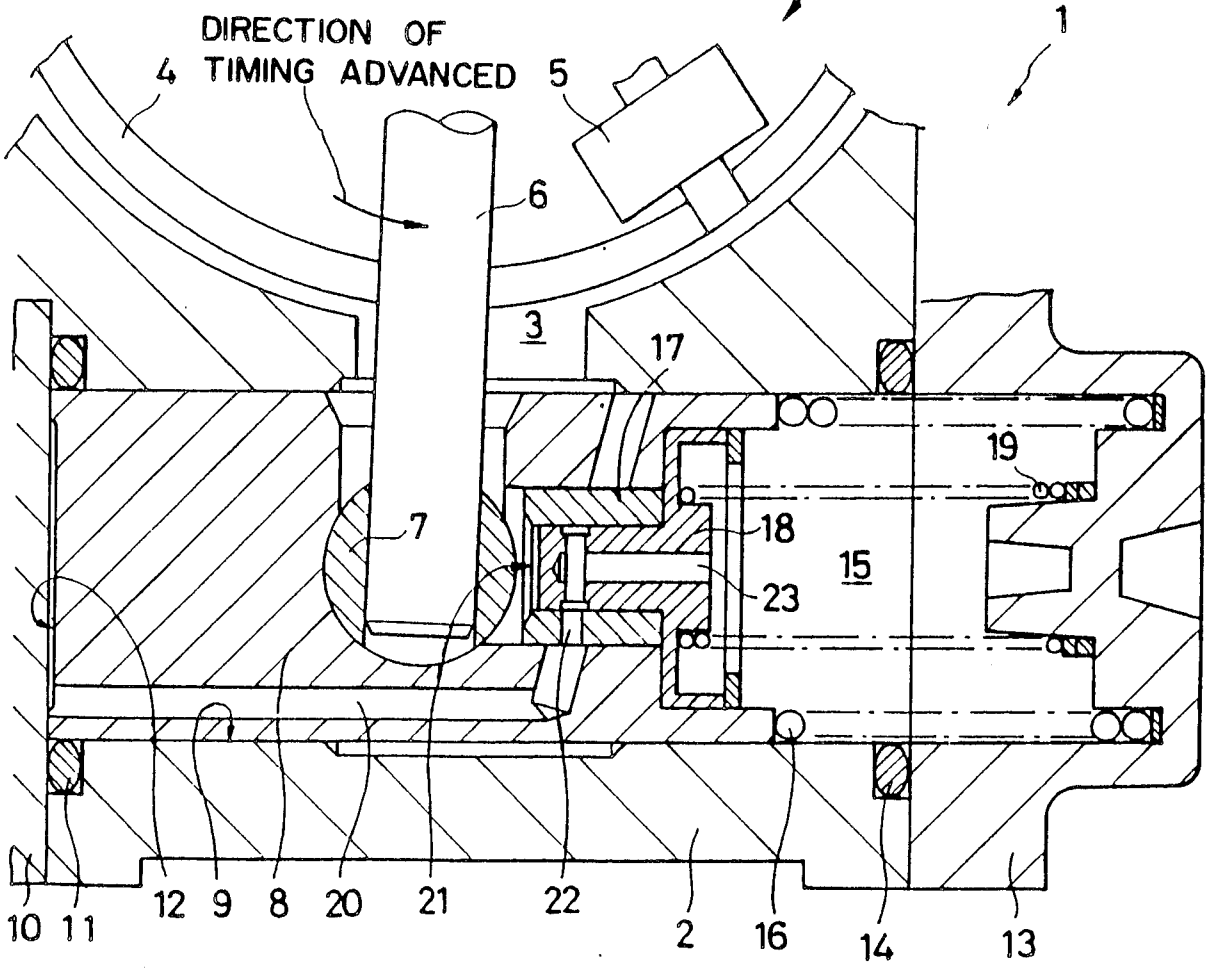
FIG. 7 PRIOR ART
FIG. 7 is a longitudinal cross-section drawing of a conventional injection timing adjustment apparatus for a distributor type fuel injection pump.
Figure 8:
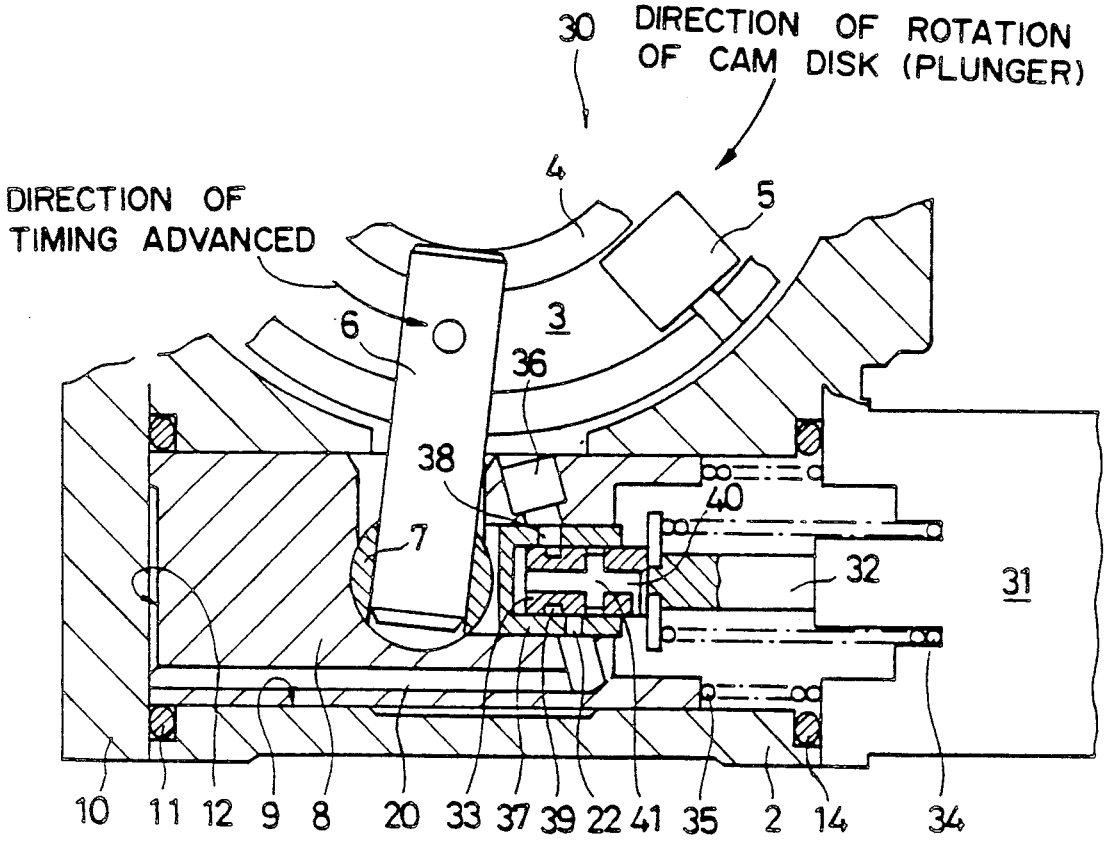
FIG. 8 PRIOR ART
FIG. 8 is a longitudinal cross-section drawing of another conventional injection timing adjustment apparatus.

As shown in FIG. 5, in the case of the injection timing control apparatus 80, the timing is advanced by using the linear solenoid 83 to move the servo valve 81 to the right, which brings the timer high-pressure chamber 54 into communication with the pump chamber 3, via the communicating groove 65, the communicating port 64, the annular groove 82, the intake port 61 and the high-pressure hydraulic passage 60. High pressure in the pump chamber 3 acting on the timer high-pressure chamber 54 moves the timer piston 53 to the right, turning the lever 6 counterclockwise.

Conversely, retardation (FIG. 6) is effected by the servo valve 81 being moved to the left by the linear solenoid 83. This brings the timer high-pressure chamber 54 into communication with the timer low-pressure chamber 55 via the communicating groove 65, the communicating port 64, the low-pressure-side communicating chamber 66, the intake port 67 and the low-pressure-side passage 68. As a result, the timer piston 53 is moved to the left and the lever 6 is turned clockwise.

Like the injection timing control apparatus 50, the servo valve 81 of the injection timing control apparatus 80 is arranged on the timer high-pressure chamber 54 side of the lever 6, and it is therefore possible to adapt the invention to engines with parts located on the servo valve 58 side.

Also, the servo valve 81 which constitutes the control rod portion of the linear solenoid 83 only has to be provided with the annular groove 82, simplifying the structure. Moreover, as the pump housing 2 and other components are the same as the ones used in mechanical injection pumps, if it is desired to implement electronic control for just the injection timing, this can be readily realized merely by replacing the linear solenoid 83 and the servo valve 81.

What is claimed is:

1. An injection timing control apparatus for a distributor type fuel injection pump comprising:

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel-injection pump chamber;

a servo valve slidably provided in the timer piston;

the servo valve being arranged on the timer high-pressure chamber side of the roller lever and coupling the pump chamber to the high-pressure chamber; and further comprising a roller provided on a roller holder which contacts a cam disk of a plunger that injects the fuel and wherein timing is advanced by moving the timer piston toward the side with the timer low-pressure chamber, the timer piston being moved toward the side with the timer low-pressure chamber by moving the servo valve away from the timer high-pressure chamber side and toward the timer low-pressure chamber side, the timer piston being moved toward the side with the timer high-pressure chamber by moving the servo valve away from the timer low-pressure chamber and toward the side with the timer high-pressure chamber; and the pressure in the fuel-injection pump chamber being employed to move the servo valve, and further comprising a guide bushing for guiding the servo valve movement affixed in the timer piston and a servo valve control pressure chamber body provided in the timer high-pressure chamber, a space between the servo valve control pressure chamber body and the servo valve comprising a servo valve control pressure chamber.

2. An injection timing control apparatus for a distributor type fuel injection pump according to claim 1 further comprising a communicating passage comprising a space between the servo valve control pressure chamber and the pump chamber.

3. An injection timing control apparatus for a distributor type fuel injection pump according to claim 2 in which the communicating passage comprise a high-pressure hydraulic passage formed in the timer piston, an intake port formed in the guide bushing and a radial communicating passage and a center communicating passage formed in the servo valve.

4. An injection timing control apparatus for a distributor type fuel injection pump according to claim 1 further comprising a servo valve control spring which urges the servo valve against the force of the pump chamber pressure.

5. An injection timing control apparatus for a distributor type fuel injection pump according to claim 1 further comprising a communicating passage which enables the timer high-pressure chamber and the pump chamber to be brought into communication when the servo valve is moved away from the timer high-pressure chamber side and toward the timer low-pressure chamber side.

6. An injection timing control apparatus for a distributor type fuel injection pump according to claim 5 in which the communicating passage comprises a high-pressure hydraulic passage formed in the timer piston, an intake port formed in the guide bushing, a radial communicating passage formed in the servo valve, and a communicating port and a communicating groove formed in the guide bushing.

7. An injection timing control apparatus for a distributor type fuel injection pump comprising:

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel injection chamber;

a servo valve slidably provided in the timer piston;

the servo valve being arranged on the timer high-pressure chamber side of the roller holder lever and coupling the pump chamber to the high pressure chamber; and further comprising a roller provided on a roller holder which contacts a cam disk of a plunger that injects the fuel and wherein timing is advanced by moving the timer piston toward the side with the timer low-pressure chamber, the timer piston being moved toward the side with the timer low-pressure chamber by moving the servo valve away from the timer high-pressure chamber side and toward the timer low-pressure chamber side, the timer piston being moved toward the side with the timer high-pressure chamber by moving the servo valve away from the timer low-pressure chamber and toward the side with the timer high-pressure chamber;

the pressure in the fuel injection pump chamber being employed to move the servo valve;

and further comprising a guide bushing for guiding the servo valve movement affixed in the timer piston and a servo valve control pressure chamber body provided in the timer high-pressure chamber; and further wherein a space between the guide bushing and the servo valve comprises a low-pressure-side communicating chamber.

8. An injection timing control apparatus for a distributor type fuel injection pump according to claim 7 further comprising a third communicating passage which enables the timer high-pressure chamber and the timer low-pressure chamber to be brought into communication via the low-pressure-side communicating chamber when the servo valve is moved away from the timer low-pressure chamber side and toward the timer high-pressure chamber side.

9. An injection timing control apparatus for a distributor type fuel injection pump according to claim 8 in which the communicating passage is comprises a communicating port and communicating groove formed in the guide bushing, an intake port formed in the guide bushing, and a low-pressure-side communicating passage formed in the timer piston.

10. An injection timing control apparatus for a distributor type fuel injection pump comprising;

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel injection pump chamber;

a servo valve slidably provided in the timer piston;

the servo valve being arrange on the timer high-pressure chamber side of the roller holder lever and coupling the pump chamber to the high-pressure chamber; and further comprising a roller provided on a roller holder which contacts a cam disk of a plunger that injects the fuel and wherein timing is advanced by moving the timer piston toward the side with the timer low-pressure chamber, the timer piston being moved toward the side with the timer low-pressure chamber by moving the servo valve away from the timer high-pressure chamber side and toward the timer low-pressure chamber side, the timer piston being moved toward the side with the timer high-pressure chamber by moving the servo valve away from the timer low--pressure chamber and toward the side with the timer high-pressure chamber; and further comprising a linear solenoid for moving the servo valve, a guide bushing for guiding the servo valve movement affixed in the timer piston, a communicating passage which enables the timer high-pressure chamber and the pump chamber to be brought into communication when the servo valve is moved away from the timer high-pressure chamber side and toward the timer low-pressure chamber side, said communicating passage comprising a high-pressure hydraulic passage formed in the timer piston, an intake port formed in the guide bushing, an annular groove formed in the servo valve and a communicating port and communicating groove formed in the guide bushing.

11. An injection timing control apparatus for a distributor type fuel injection pump according to claim 10 in which the linear solenoid for moving the servo valve is arranged on a side of the servo valve opposite the roller holder lever.

12. An injection timing control apparatus for a distributor type fuel injection pump comprising:

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel injection pump chamber;

a servo valve slidably provided in the timer piston;

the servo valve being arranged on the timer high-pressure chamber side of the roller holder lever and coupling the pump chamber to the high pressure chamber;

a roller provided on a roller holder which contacts a cam disk of a plunger that injects the fuel and wherein timing is advanced by moving the timer piston toward the side with the timer low-pressure chamber, the timer piston being moved toward the side with the timer low-pressure chamber by moving the servo valve away from the timer high-pressure chamber side and toward the timer low-pressure chamber side, the timer piston being moved toward the side with the timer high-pressure chamber by moving the servo valve away from the timer low-pressure chamber and toward the side with the timer high-pressure chamber;

and further comprising a linear solenoid for moving the servo valve, and a guide bushing for guiding the servo valve movement fixed in the timer piston, a space bettween the guide bushing and the servo valve comprising a low-pressure side communicating chamber.

13. An injection timing control apparatus for a distributor type fuel injection pump according to claim 12 further comprising a communicating passage which enables the timer high-pressure chamber and the timer low-pressure chamber to be brought into communication via the low-pressure-side communicating chamber when the servo valve is moved away from the timer low-pressure chamber side and toward the timer high-pressure chamber side.

14. An injection timing control apparatus for a type fuel injection pump according to claim 13 in which the third communicating passage comprises a communicating port and communicating groove formed in the guide bush, an intake port formed in the guide bush, and a low-pressure-side communicating passage formed in the timer piston.

15. An injection timing control apparatus for a distributor type fuel injection pump comprising:

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel injection pump chamber;

a servo valve slidably provided in the timer piston;

a roller provided on a roller holder which contacts a cam disk of a plunger that injects the fuel;

the servo valve being arranged on the timer high-pressure chamber side of the roller holder lever and coupling the pump chamber to the high-pressure chamber;

the fuel injection timing being advanced by moving the timer piston toward the side with the timer low-pressure chamber;

the timer piston being moved toward the side with the timer low-pressure chamber by moving the servo valve away from the timer high-pressure chamber side and toward the timer low-pressure chamber side, and the timer piston being moved toward the side with the timer low-pressure chamber by moving the servo valve away from the time low-pressure chamber and toward the side with the timer high-pressure chamber;

the pressure in the fuel injection pump chamber being employed to move the servo valve, and further comprising means for guiding the servo valve affixed in the timer piston and a servo valve control pressure chamber body provided in the timer high-pressure chamber, a space between the servo valve control pressure chamber and the servo valve comprising a servo valve control pressure chamber.

16. An injection timing control apparatus for a distributor type fuel injection pump according to claim 15 further comprising a communicating passage comprising a space between the servo valve control pressure chamber and the pump chamber.

17. An injection timing control apparatus for a distributor fuel type injection pump according to claim 16 in which the communicating passage comprises a high-pressure hydraulic passage formed in the timer piston, an intake port formed in the means for guiding and a radial communicating passage and a center communicating passage formed in the servo valve.

18. An injection timing control apparatus for a distributor type fuel injection pump according to claim 15 further comprising a servo valve control spring which urges the servo valve against the force of the pump chamber pressure.

19. An injection timing control apparatus for a distributor type fuel injection pump according to claim 15 further comprising a communicating passage which enables the timer high-pressure chamber and the pump chamber to be brought into communication when the servo valve is moved away from the timer high-pressure chamber side and toward the timer low-pressure chamber side.

20. An injection timing control apparatus for a distributor type fuel injection pump according to claim 19 in which the communicating passage comprises a high-pressure hydraulic passage formed in the timer piston, an intake port formed in the means for guiding, a radial communicating passage formed in the servo valve, and a communicating port and a communicating groove formed in the guide bushing.

21. An injection timing control apparatus for a distributor type fuel injection pump comprising:

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel injection pump chamber;

a servo valve slidably provided in the timer piston;

a roller provided on a roller holder which contacts a cam disk of a plunger that injects the fuel;

the servo valve being arranged on the timer high-pressure chamber side of the roller holder lever and coupling the pump chamber to the high-pressure chamber;

the fuel injection timing being advanced by moving the timer piston toward the side with the timer low-pressure chamber;

the timer piston being moved toward the side with the timer low-pressure chamber by moving the servo valve away from the timer high-pressure chamber side and toward the timer low-pressure chamber side, and the timer piston being moved toward the side with the timer high-pressure chamber by moving the servo valve away from the timer low-pressure chamber and toward the side with the timer high-pressure chamber;

the pressure in the fuel-injection pump chamber being employed to move the servo valve, and further comprising means for guiding the servo valve affixed in the timer piston and a servo valve control pressure chamber body provided in the timer high pressure chamber, a space between the means for guiding and the servo valve comprising a low pressure side communicating chamber.

22. An injection timing control apparatus for a distributor type fuel injection pump according to claim 21 further comprising a communicating passage which enables the timer high-pressure chamber and the timer low-pressure chamber to be brought into communication via the low-pressure-side communicating chamber when the servo valve is moved away from the timer low-pressure chamber side and toward the timer high-pressure chamber side.

23. An injection timing control apparatus for a distributor type fuel injection pump according to claim 21 in which the communicating passage comprises a communicating port and communicating groove formed in the means for guiding, an intake port formed in the guide bushing, and a low-pressure-side communicating passage formed in the timer piston.

24. An injection timing control apparatus for a distributor type fuel injection pump comprising:

a timer piston which is associated and operatively connected with a roller holder lever, a high-pressure chamber being disposed on one side of the piston and a low-pressure chamber being disposed on an opposite side of the piston, the piston moving in response to the pressure in the timer high-pressure chamber, the pump having a fuel injection pump chamber;

a servo valve slidably provided in the timer piston;

a roller provided on a roller holder which contacts a cam disk of a plunger that injects the fuel;

the servo valve being arranged on the timer high-pressure chamber side of the roller holder lever and coupling the pump chamber to the high-pressure chamber;

the fuel injection timing being advanced by moving the timer piston toward the side with the timer low-pressure chamber;

the timer piston being moved toward the side with the timer low-pressure chamber by moving the servo valve away from the timer high-pressure chamber side and toward the timer low-pressure chamber side, the timer piston being moved toward the side with the timer high-pressure chamber by moving the servo valve away from the timer low-pressure chamber and toward the side with the timer high-pressure chamber; and further comprising a linear solenoid for moving the servo valve and means for guiding the servo valve movement affixed to the timer piston, a communicating passage which enables the timer high pressure chamber and the pump chamber to be brought into communication when the servo valve is moved away from the timer high pressure chamber side and toward the timer low pressure chamber side, the communicating passage comprising a high-pressure hydraulic passage formed in the timer piston, an intake port formed in the means for guiding, an annular groove formed in the servo valve and a communicating port and communicating groove formed in the means for guiding.

25. An injection timing control apparatus for a distributor type fuel injection pump according to claim 24 in which the linear solenoid for moving the servo valve is arranged on a side of the servo valve opposite the roller holder lever.

26. An injection timing control apparatus for a distributor type fuel injection pump comprising:

a timer piston which is associated and operatively connected with a roller holder lever, and a high-pressure chamber being disposed on one side of the piston and a low-pressure chamber being disposed on an opposite side of the piston, the piston moving in response to the pressure in the timer high-pressure chamber, the pump having a fuel injection pump chamber;

a servo valve slidably provided in the timer piston;

a roller provided on a roller holder which contacts a cam disk of a plunger that injects the fuel;

the servo valve being arranged on the timer high-pressure chamber side of the roller holder lever and coupling the pump chamber to the high-pressure chamber;

the fuel injection timing being advanced by moving the timer piston toward the side with the timer low-pressure chamber;

the timer piston being moved toward the side with the timer low-pressure chamber by moving the servo valve away from the timer high-pressure chamber side and toward the timer low-pressure chamber side, the timer piston being moved toward the side with the timer high-pressure chamber by moving the servo valve away from the timer low-pressure chamber and toward the side with the timer high-pressure chamber; and further comprising a linear solenoid for moving the servo valve and means for guiding the servo valve movement affixed in the timer piston, a space between the means for guiding and the servo valve comprising a low-pressure side communicating chamber.

27. An injection timing control apparatus for a distributor type fuel injection pump according to claim 26 further comprising a communicating passage which enables the timer high-pressure chamber and the timer low-pressure chamber to be brought into communication via the low-pressure-side communicating chamber when the servo valve is moved away from the timer low-pressure chamber side and toward the timer high-pressure chamber side.

28. An injection timing control apparatus for a distributor type fuel injection pump according to claim 27 in which the communicating passage comprises a communicating port and communicating groove formed in the guide bushing, an intake port formed in the guide busing, and a low-pressure-side communicating passage formed in the timer piston.

* * * * *